United States Patent [19]

Musgrave

[11] 4,291,483

[45] Sep. 29, 1981

[54] CARTRIDGE RECEPTACLE

[76] Inventor: Daniel D. Musgrave, 8201 Caraway St., Cabin John, Md. 20731

[21] Appl. No.: 109,129

[22] Filed: Jan. 2, 1980

[51] Int. Cl.[3] ..... F42B 39/06

[52] U.S. Cl. ..... 42/87

[58] Field of Search ..... 42/87, 88

[56] References Cited

U.S. PATENT DOCUMENTS

| | | | |
|---|---|---|---|
| 1,178,785 | 4/1916 | Debuchy | 42/87 |
| 2,137,680 | 11/1938 | Vogel | 42/88 |
| 2,462,836 | 3/1949 | Barker et al. | 42/88 |
| 3,242,609 | 3/1966 | Koistinen | 42/87 |
| 3,710,497 | 1/1973 | Musgrave | 42/87 |
| 3,854,232 | 12/1974 | Musgrave | 42/87 |
| 4,020,974 | 5/1977 | Bauer et al. | 42/87 |

*Primary Examiner*—Charles T. Jordan

[57] ABSTRACT

A cartridge receptacle adapted to facilitate the filling of a cartridge magazine, by hand. To permit efficient manipulation during the filling operation, the receptacle can be affixed to the magazine, whereby both can be held in one hand. The other hand is thus free to insert the cartridges into the magazine. The receptacle can be adapted for use with various cartridges, various cartridge clips, and various magazines. The receptacle can also be used with loose cartridges.

9 Claims, 5 Drawing Figures

CARTRIDGE RECEPTACLE

Many modern firearms employ detachable magazines which can be removed from the firearms for refilling, when expended. This operation must sometimes be performed under adverse environmental conditions such as mud, sand, dust, or precipitation. It is highly important to exclude foreign matter from the magazine, but it is also important to reduce the time required for filling to a minimum.

The number of steps required to fill a magazine varies with different models of firearms. To speed up the process, many magazines are filled by stripping groups of cartridges from clips, directly into the magazine. This usually requires some type of guide to align the clip and the magazine. As it frequently requires several clips to fill a magazine, and as the user has only two hands, he must manipulate clips, guide, and magazine, carefully, to avoid contamination of the filled magazine.

It is readily apparent that any simplification of the filling operation would make it quicker and easier to perform.

In some instances cartridges of the same model can be used with various firearms, which may use different magazines. Cartridges of the same configuration may also be supplied by various producers on different clips. It could thus happen that the guide mentioned above might be of such a configuration that it would not fit the clip, the magazine, or both. In such a situation it would be necessary to remove the cartridges from the clip and insert them individually into the magazine, by hand. The same method must be employed when no guide happens to be available.

In consideration of the aforesaid circumstances, the principal object of this invention is to provide a cartridge receptacle which includes means for engaging a magazine.

Another object is to provide such a receptacle having integral clip guide means.

Another object is to provide such a receptacle which can be used with various cartridges, clips, and magazines.

These and other objects of the present invention will be apparent upon reference to the following specification, taken in connection with the accompanying drawings, wherein.

Figure 3:
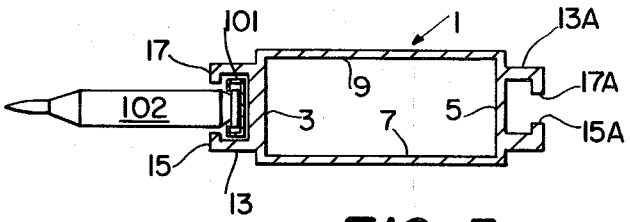
FIG. 3 is a horizontal section taken in the plane indicated by line 3—3 on FIG. 1.

No particular magazine, cartridge, or clip is shown in the drawing, which has been prepared for purposes of disclosure only. The invention will be useful with types of magazines, cartridges, and clips other than those shown and the illustrations should not be construed as limiting the scope of utility of the invention. The drawing is not to scale.

Figure 1:
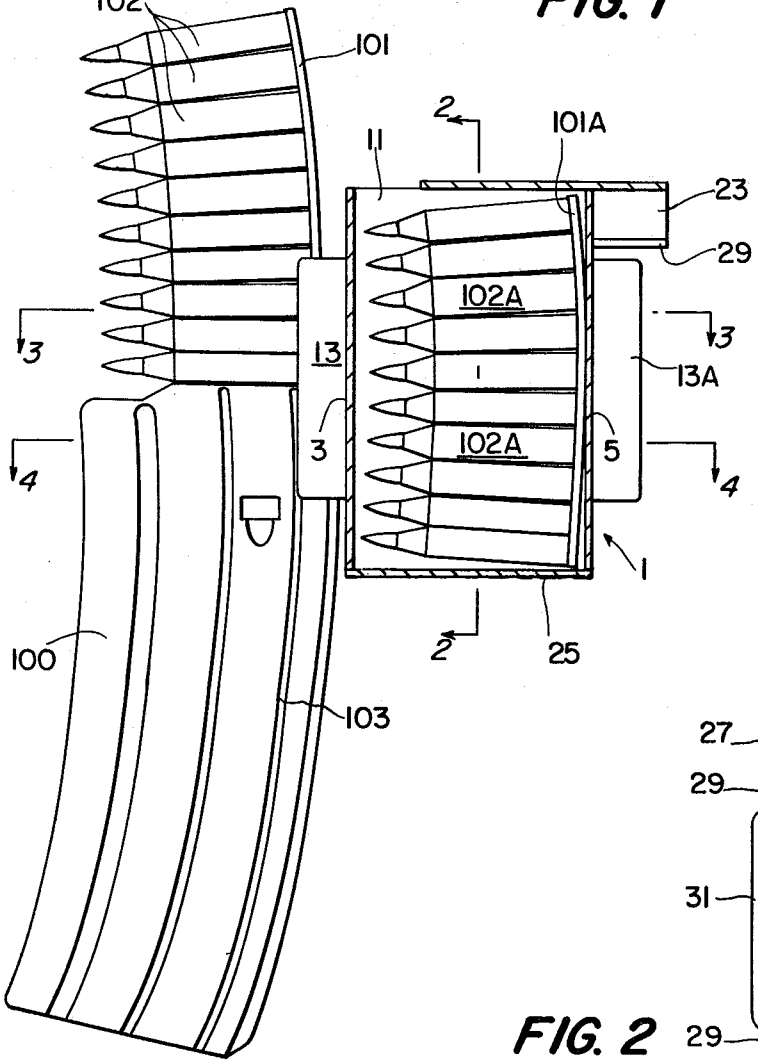
FIG. 1 is a view of a cartridge receptacle engaged with a magazine and supporting a clip of cartridges in position for stripping into the magazine.

Referring to the drawing in detail, FIG. 1 shows a typical cartridge magazine 100 having engaged therewith a cartridge receptacle 1 which may be constructed of any suitable material such as a metal or a plastic. Receptacle 1 is generally rectangular in configuration and it comprises front wall 3, rear wall 5, and side walls 7 and 9, which are numbered in FIG. 2. The top and bottom of the receptacle comprise open passages which can be closed by cover means described hereinafter. One of the passages is indicated by numeral 11 in FIG. 1.

Affixed to front wall 3 is guide 13 which includes a portion adapted for supporting a cartridge clip 101, and another portion adapted for engaging magazine 100. As can be seen in FIG. 1, clip 101 is holding a plurality of cartridges 102, which are properly positioned for stripping from the clip into the magazine. The use of such guides for this purpose is well-known in the art and need not be explained in detail here.

Figure 4:
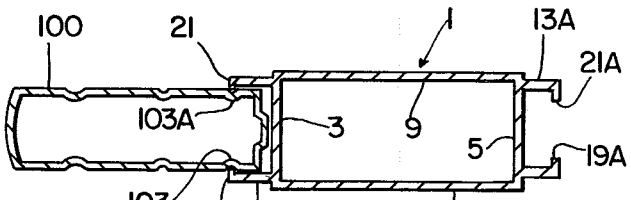
FIG. 4 is a horizontal section taken in the plane indicated by line 4—4 on FIG. 1.

The structure of the guide can be seen best in FIG. 3 and FIG. 4. Guide 13 is shaped somewhat like a channel with inwardly turned lips 15 and 17. The spacing between the lips is sufficient to allow cartridges 102 to pass, while retaining clip 101 in position. Detent means on the clip (not shown) can cooperate with suitable stop means on the guide (not shown) to limit insertion of the clip into the channel. This is a common practice in the art.

The lower portion of the guide comprises a pair of jaws 19 and 21, which are adapted to engage magazine 100. A common practice in the art is to have such jaws engage in stiffening grooves which are formed in the casing of the magazine. Such a groove is indicated by numeral 103 on FIG. 1, and a similar groove (not visible in the drawing) would be formed on the opposite side of the magazine. In FIG. 4 these grooves are indicated by numerals 103 and 103A.

In the interior of receptacle 1 is stored a clip 101A carrying a plurality of cartridges 102A. This clip is identical to clip 101, and the cartridges are identical to cartridges 102. The receptacle can be made of such a size and shape as to contain a quantity of clips of the type necessary to fill the magazine.

Cover means are provided to close the openings in the top and bottom of the receptacle. Cover 23 closes the top, and cover 25 closes the bottom. A buttress 27 is formed along opposite edges of each opening in the receptacle. Each cover has a corresponding pair of lips 29 which extend inward from the sides of the cover and are adapted to engage with the buttresses as appears in FIG. 2. The covers can thus slide on and off the receptacle. In FIG. 1 cover 23 has been slid partly off the receptacle.

It is readily apparent that other cover arrangements could be used. The covers could be hinged, or otherwise secured to the receptacle.

Figure 2:
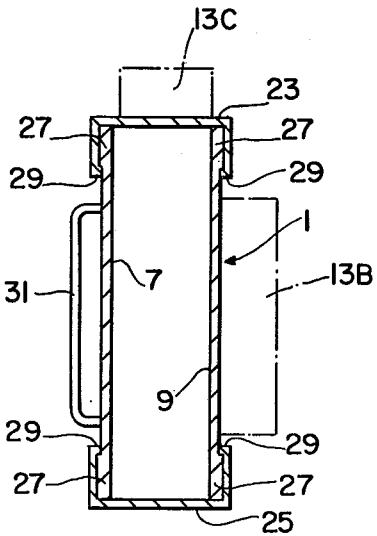
FIG. 2 is a cross section taken in the plane indicated by line 2—2 on FIG. 1.

In order to provide for the use of the receptacle with various clips, or with various magazines, additional guides can be provided. In FIG. 1, guide 13A is similar in principle to guide 13, but is configured to engage with a different type of magazine, or to support a different type of clip, or both. If additional guides are needed they can be positioned as shown in FIG. 2, where guide 13B is on sidewall 9 and guide 13C is on cover 23. A single model of receptacle can thus be provided so as to be compatible with a considerable variety of clips and magazines.

Of course, these additional guides increase the bulk of the receptacle to some extent. The number of guides required to insure compatibility with a specified assortment of clips and magazines can be reduced by designing each guide so as to accept two different magazines as disclosed in U.S. Pat. No. 3,710,497. This requires that the guide be invertable. As the guide in the present invention is affixed to the receptacle, the entire receptacle is made invertable, with an opening and cover at the top, and at the bottom. As all modern cartridge clips are invertable, it is immaterial whether the so-called top or the so-called bottom is uppermost when the receptacle is engaged with a magazine. The cartridges can be stripped from either end of a modern clip. By making the guide or guides integral with the receptacle for supplying cartridges, which are normally issued on clips, the possibility that a user will not have a guide when needed is greatly reduced. The arrangement of the elements of the invention disclosed herein is but one of several possibilities. Other arrangements can be used, depending upon circumstances such as different configurations of clips, or of magazines. The clip support means and the magazine engagement means can be positioned in any of several orientations relative to the receptacle.

The receptacle can be made transparent, so that a user can easily determine its contents. It can also be made waterproof. Means such as loop 31 in FIG. 2 can be provided to attach the receptacle to a support which might be on the person of a user. It can also be carried in a pouch, or in a pocket.

Several new and useful results are achieved with the present invention. The receptacle comprises a self-contained unit for filling a magazine in a minimum of time. The user can conveniently hold the several items needed for the operation in two hands. It is thereby not necessary, for example, to rest any item on the ground where it might become contaminated.

The guide, or guides, being attached to the receptacle, will positively arrive with the ammunition. One receptacle can be compatible with several diverse magazines, such as those of the various members of NATO. This contrasts with the existing situation wherein a NATO user may be supplied cartridges on clips and have no guide available or may happen to receive with the ammunition a guide which does not fit his magazine.

Figure 5:
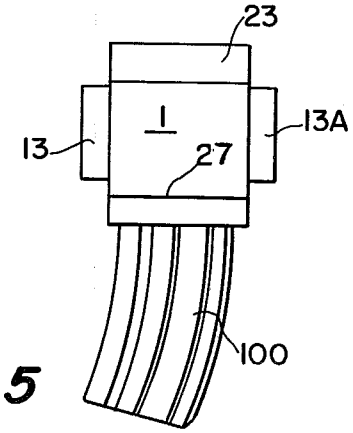
FIG. 5 is a view of a cartridge receptacle use as a cover on the feed end of a magazine.

The capability of using the empty receptacle as a magazine cover is another advantage achieved by this invention. The use of such a cover is a standard practice in the art, but the present invention assures that a cover will always be available precisely when needed. This is disclosed in FIG. 5, where filled magazine 100 has been inserted partly into empty receptacle 1, to exclude dirt.

It is not essential that the receptacle be used with cartridges supplied on clips. Loose cartridges stored in a receptacle could be inserted into a magazine individually, while the receptacle is engaged with the magazine.

There is thus disclosed a simple receptacle which can be used to supply cartridges for filling any of a variety of magazines. The invention can be used both with existing, and with future, firearms.

I claim:

1. A receptacle adapted for containing at least one clip of cartridges, said receptacle including: magazine engagement means; and external clip support means.

2. A combination as set forth in claim 1 wherein said engagement means and said support means are integral with said receptacle.

3. A receptacle as set forth in claim 1 wherein cartridges carried on a clip positioned on said support means are positionally adapted for stripping directly into a magazine engaged with said engagement means.

4. A receptacle as set forth in claim 1 wherein said magazine engagement means are plural and dissimilar inter se.

5. A receptacle as set forth in claim 1 wherein said clip support means are plural and dissimilar inter se.

6. A receptacle as set forth in claim 1 said receptacle having at least one opening to an interior thereof, said receptacle also being provided with moveable cover means adapted to close said opening.

7. A receptacle as set forth in claim 1 said receptacle including a plurality of openings to an interior thereof, each of said openings being provided with moveable cover means.

8. A receptacle as set forth in claim 8 wherein said engagement means and said support means are integral with said cover means.

9. A receptacle as set forth in claim 1 said receptacle being adapted for use as cover means on a magazine.

* * * * *